US005762203A

United States Patent [19]

Klawiter et al.

[11] Patent Number: 5,762,203

[45] Date of Patent: Jun. 9, 1998

[54] CONTAINER FOR SHIPPING AND DISPLAYING OF PRODUCT

[75] Inventors: Steven C. Klawiter, Garner, N.C.; Kevin Harrell, Philadelphia, Pa.

[73] Assignee: Goodmark Foods, Inc., Raleigh, N.C.

[21] Appl. No.: 742,936

[22] Filed: Nov. 1, 1996

[51] Int. Cl.[6] ..... B65D 51/24

[52] U.S. Cl. ..... 206/768; 206/736

[58] Field of Search ..... 206/45.28, 45.29, 206/45.3, 459.5, 736, 766, 767, 768

[56] References Cited

U.S. PATENT DOCUMENTS

| | | | |
|---|---|---|---|
| 267,271 | 11/1882 | Snow . | |
| 414,450 | 11/1889 | Schwartz . | |
| 476,765 | 6/1892 | Knapp . | |
| 527,688 | 10/1894 | Hernsheim . | |
| 529,760 | 11/1894 | Stevens . | |
| 937,173 | 10/1909 | Pfeiffer . | |
| 1,104,253 | 7/1914 | Dunphee . | |
| 1,403,869 | 1/1922 | Reid . | |
| 1,452,257 | 4/1923 | Singer et al. . | |
| 1,599,983 | 9/1926 | Bergstien . | |
| 1,648,280 | 11/1927 | Pitts | 206/45.29 |
| 1,743,502 | 1/1930 | Tanner . | |
| 1,755,731 | 4/1930 | Guyer . | |
| 1,799,656 | 4/1931 | Tinsley | 206/45.3 |
| 1,800,550 | 4/1931 | Mahoney, Jr. et al. . | |
| 1,817,045 | 8/1931 | Tanner . | |
| 1,889,625 | 11/1932 | Barter . | |
| 2,054,596 | 9/1936 | Ford . | |
| 2,119,789 | 6/1938 | Krout . | |
| 2,168,240 | 8/1939 | Roberts . | |
| 2,209,657 | 7/1940 | Martin . | |
| 2,337,596 | 12/1943 | Gariepy . | |
| 2,375,843 | 5/1945 | Gottlieb . | |
| 2,771,986 | 11/1956 | Bekoff . | |
| 2,812,852 | 11/1957 | Samuels . | |
| 3,351,182 | 11/1967 | Greer | 206/768 |
| 3,417,861 | 12/1968 | Levy | 206/45.28 |
| 3,729,091 | 4/1973 | Davis | 206/45.29 |
| 4,756,409 | 7/1988 | Murray | 206/45.34 |
| 4,860,886 | 8/1989 | Northrup et al. | 206/45.29 |
| 5,337,821 | 8/1994 | Fierek | 206/44 R |

FOREIGN PATENT DOCUMENTS

| | | | |
|---|---|---|---|
| 434236 | 8/1935 | United Kingdom | 206/45.29 |
| 940131 | 1/1963 | United Kingdom | 206/45.29 |
| 2234959 | 2/1991 | United Kingdom | 206/45.29 |
| 2252546 | 8/1992 | United Kingdom | 206/45.29 |

*Primary Examiner*—Jimmy G. Foster

*Attorney, Agent, or Firm*—Bell Seltzer Intellectual Property Law Group of Alston & Bird LLP

[57] ABSTRACT

A display container is formed from a unitary sheet material and comprises a receptacle for receiving the product and a display flag. The receptacle has a floor and a plurality of upright side walls attached thereto that define a product cavity which has an open upper end. The display flag comprises a cantilevered shaft member attached to an upper edge of one of the upright side walls and extending generally horizontally therefrom over a portion of the product cavity upper end, and further comprises a flag member attached to an end of the shaft member and extending generally vertically therefrom. In this configuration, the flag member can dangle in a position to catch a consumer's attention; however, no assembly of parts by a retail store employee is required.

24 Claims, 5 Drawing Sheets

50
36
52
54
32
56
33
34
12
26
14
20

CONTAINER FOR SHIPPING AND DISPLAYING OF PRODUCT

FIELD OF THE INVENTION

The present invention relates generally to packaging, and more specifically to a packaging container which can serve as both a shipping and display container.

BACKGROUND OF THE INVENTION

Erectable display containers for storing and displaying a product are known. Typically, such containers are formed from a blank of sheet material cut and scored to provide an array of side-by-side panels joined along common sides. The panels are typically defined by score or fold lines along which they are folded relative to one another to erect a three-dimensional container. The product then resides within the container in a retail store until purchase.

Some display containers serve as shipping containers also. A common configuration is one in which a rectangular box with a hinged lid serves as the shipping container. Product is packed inside the container, after which the lid is closed. Multiple shipping containers are shipped together in a larger carton or crate. After the containers arrive at the retail store, the lid is removed (often by tearing along a linear perforation included in a side wall of the container) to enable the product to be accessed. The open container is then placed on the store shelf, where the product can be accessed by customers.

Of course, a display container is intended to capture the attention of consumers and to distinguish a suppliers'products from those of a competitor. One way to distinguish one's products from those of a competitor is to package them in colorful and creative containers. However, this technique is often ineffective because the containers are placed on a store shelf next to other products that are also packaged in colorful containers. An additional problem is that the merchandise is often placed at the back of a shelf, away from the aisle and out of a consumer's direct line of sight.

A second technique for capturing consumers'attention is to place merchandise on stand-alone displays that are set at the end of or in the middle of store aisles. However, this technique is problematic because there are limited spaces at the end of aisles to place such stand-alone displays. Moreover, many stores may be reluctant to place displays in positions where they can obstruct the traffic pattern of consumers or be easily knocked over.

A third approach to distinguishing one's products from those of a competitor is to place them in a large container and attach an accessory, such as a sign or card, on the front of the container so that it projects from the shelf and into an aisle. The theory behind this approach is that by including a structure that in essence confronts the consumer, his attention will be drawn to the product.

This approach can present several difficulties. First, the accessory is generally a separate piece from the container which must be manufactured separately. This additional piece raises the cost of the display. Also, because the accessory is a separate piece, attachment of the accessory is often performed by an employee at the retail store, who may have no particular interest in bothering to set up the display properly. Moreover, these accessories tend to be flimsy and easily damaged, particularly when positioned to extend into an aisle.

SUMMARY OF THE INVENTION

In view of the foregoing, it is an object of the present invention to provide a display container that can effectively draw a consumer's eye.

It is also an object of the invention to provide a display container that does so without requiring additional assembly steps by a retail store employee.

It is a further object of the invention to provide a display container that meets these criteria and can also serve as a shipping container for the product.

It is an additional object of the present invention to provide a display container that meets the above-noted objects and can be inexpensively produced.

These and other objects are satisfied by the present invention, which includes a display container for displaying a product for sale. The display container is formed from a unitary sheet material and comprises a receptacle for receiving the product and a display flag. The receptacle has a floor and a plurality of upright side walls attached thereto that define a product cavity which has an open upper end. The display flag comprises a cantilevered shaft member attached to an upper edge of one of the upright side walls and extending generally horizontally therefrom over a portion of the product cavity upper end, and further comprises a flag member attached to an end of the shaft member and extending generally vertically therefrom. In this configuration, the flag member can dangle in a position to catch a consumer's attention; however, no assembly of parts by a retail store employee is required.

As an additional aspect, the present invention includes a container suitable for shipping a product that can be converted into a display container. The shipping container comprises a receptacle for storing the product, a cover panel, and a display flag. The receptacle has a floor and a plurality of upright side walls attached thereto which define a product cavity. A first of the side walls includes a frangible section, and a second of the side walls is free of a frangible section. The cover panel is attached to an upper edge of the first side wall, is generally horizontally disposed and overlies the product cavity to restrict access thereto. The display flag comprises a cantilevered shaft member hingedly attached to an upper edge of the second side wall and a flag portion attached to an end of the shaft member opposite the second side wall. The first side wall is configured such that removal of the frangible section removes the cover panel and provides access to the product cavity. The display flag is configured to underlie the cover panel prior to removal of the cover panel and the frangible section and to overlie the product cavity when the cover panel and the frangible section are removed. This configuration allows a shipping container to be converted into a display container of the variety described above.

DETAILED DESCRIPTION OF THE PREFERRED EMBODIMENTS

The present invention will now be described more particularly hereinafter with reference to the accompanying drawings, in which an embodiment of the invention is shown. The invention can, however, be embodied in many different forms and should not be limited to the embodiment set forth herein; rather, this embodiment is provided so that this disclosure will be thorough and complete and will fully convey the scope of the invention to those skilled in this art.

Figure 2:
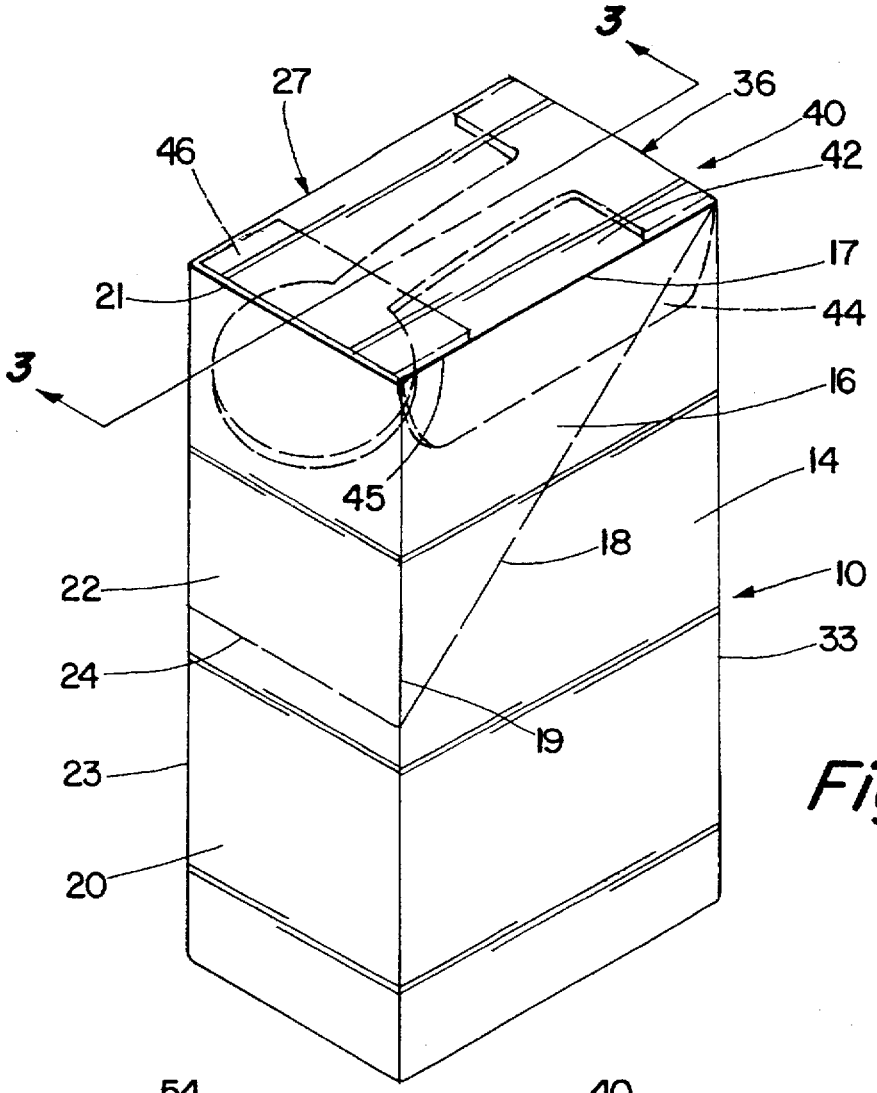
FIG. 2 is a perspective view of a shipping container from which the shipping container of FIG. 1 can be formed.
Figure 3:
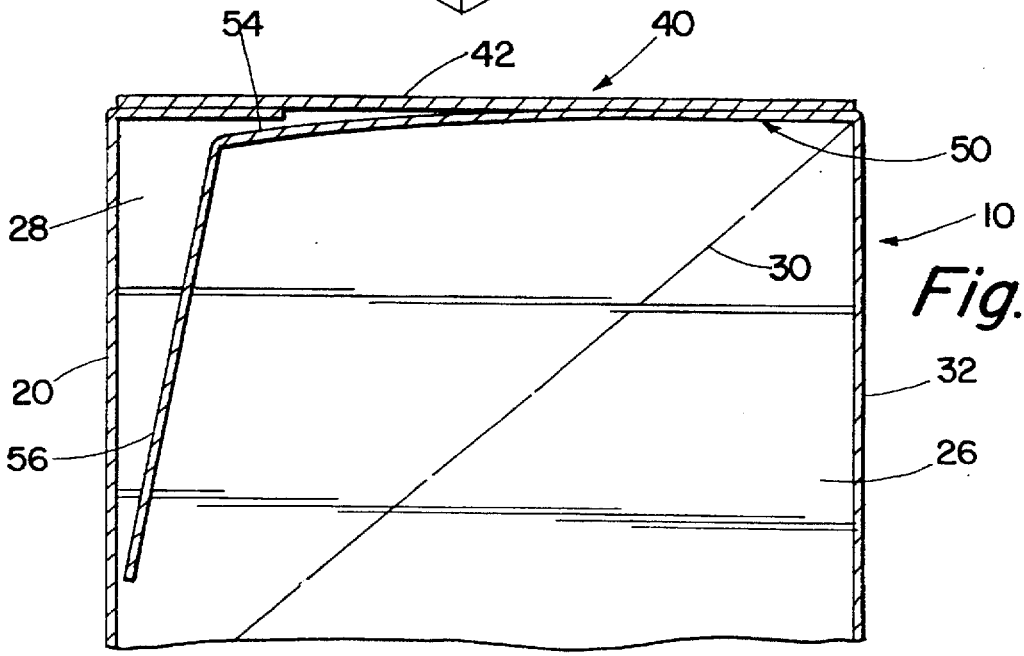
FIG. 3 is a section view of the shipping container of FIG. 2 taken along lines 3—3 thereof.
Figure 6:
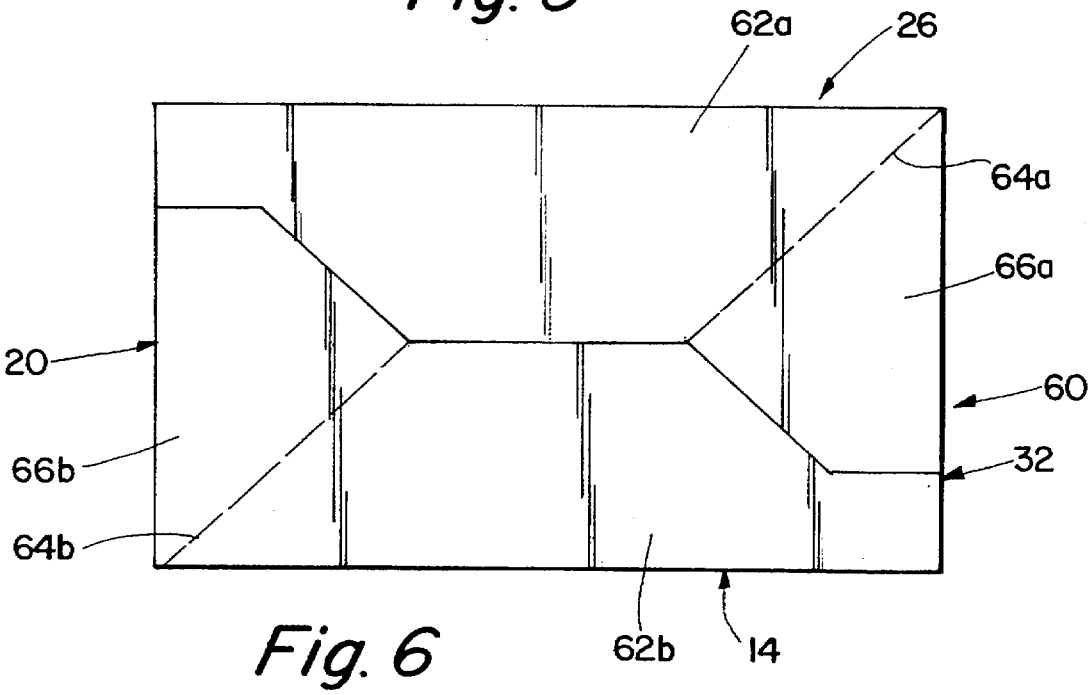
FIG. 6 is a bottom view of the container of FIG. 1.

Referring now to the Figures, a shipping container, designated broadly at 10, is shown in FIGS. 2 and 3. The container 10 is a rectangular receptacle having four adjoining side walls 14, 20, 26 and 32, a cover 40 and a floor 60 (best seen in FIGS. 4 and 6). A flag member 50 is attached to the sidewall 32. Each of the separate parts of the shipping container 10 is described hereinbelow.

The sidewall 14 is generally upright and includes a removable section 16. The removable section 16 is defined by its upper edge 17, an upper portion of the front edge 19 of the sidewall 14, which it shares with the sidewall 20, and a perforation 18 which extends rectilinearly from the upper rear corner of the sidewall 14 downwardly to a central portion of the edge 19. The upper edge 17 of the removable section 16 is free; i.e., it has no other structure attached thereto.

The sidewall 20 (FIGS. 2 and 3) is adjacent to the sidewall 14 and, as noted above, shares the edge 19 thereof. The sidewall 20 includes a removable section 22 defined by its upper edge 21, the edge 19, a side edge 23 that is opposite the edge 19 and is shared with the sidewall 26, and a horizontal perforation 24 which originates from the lower end of the perforation 18 of the sidewall 14 and extends horizontally across a central portion of the sidewall 20 to the side edge 23. A folding tab 46 is hingedly attached to the upper edge 21.

The sidewall 26 (best seen in FIGS. 1 and 3) is adjacent to and shares the edge 23 with the sidewall 20 and is also directly opposite the sidewall 14. The sidewall 26 includes a removable section 28 defined by its upper edge 27, an upper portion of the edge 23, and a perforation 30 that extends from the upper rear corner of the sidewall 26 rectilinearly downwardly to meet with the end of the perforation 24. The cover 40 is hingedly attached to the upper edge 27 of the sidewall 26.

The sidewall 32 (FIGS. 1 and 3) extends between a rear edge 33, which it shares with the sidewall 14, and an edge 34, which it shares with the sidewall 26. The sidewall 32 is free of any perforations. The flag member 50 is hingedly attached to the upper edge 35 of the sidewall 32.

The cover 40 (see FIGS. 2 and 3) includes a cover panel 42 and a locking panel 44. The cover panel 42 is directly hinged to the upper edge 27 of the sidewall 26. The locking panel 44 (seen best in FIG. 4) is hingedly attached to an edge 45 of the cover panel 42 opposite the sidewall 26. The cover panel 42 is substantially the same length (i.e., the distance between the upper edge 27 of the sidewall 26 and the edge 45) as the width of the sidewalls 20 and 28.

Figure 5:
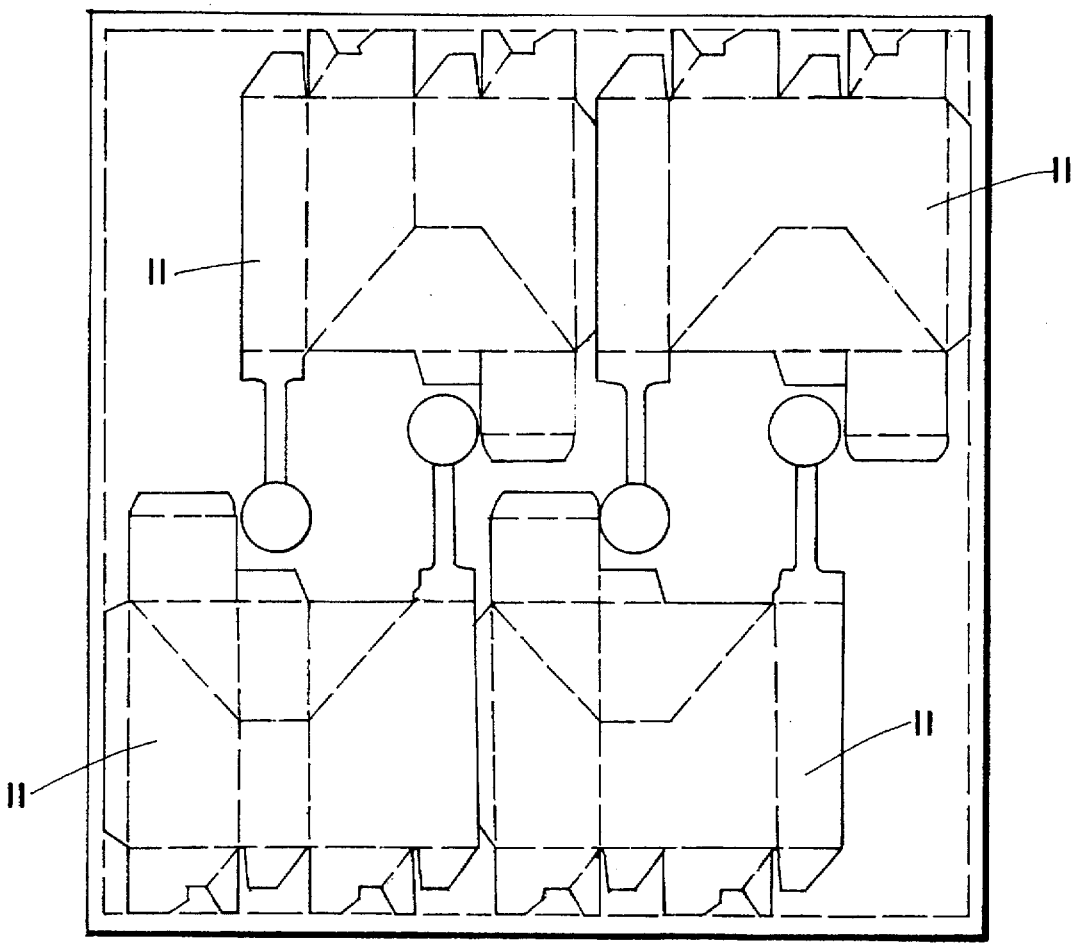
FIG. 5 is a plan view of four sheet blanks of FIG. 4 cut from a single cardboard sheet.

The folding tab 46 (FIGS. 2, 3 and 5) is hingedly attached at one end to the upper edge 21 of the sidewall 20. The folding tab 46 is configured to interact with the cover 40 to retain it in a closed position.

The flag member 50 (FIGS. 1 through 3) is hingedly attached to the upper edge 35 of the sidewall 32. The flag member 50 includes a base 52, which is hinged directly to the upper edge 35, a narrowed shaft portion 54 that extends away from the base 52, and a circular flag member 56 attached to the end of the shaft portion opposite the base 52. Together, the length of the base 52 and shaft portion 54 (i.e., the distance they extend away from the sidewall 32) is slightly less than the width of the sidewalls 14 and 26. The base 52 is configured as the mirror image of the folding tab 46 and therefore interacts with the cover 40 to retain it in a closed position.

The floor 60 of the container 10 (FIG. 6) comprises two sets of interlocking panels attached to the lower edges of the sidewalls 14, 20, 26, 32. A floor panel **62*a* is hingedly attached at one edge to the lower edge of the sidewall 26. The floor panel 62*a* includes an adhesion section 66*a*, which is separated from the remainder of floor panel 62*a* by a fold line 64*a*. Similarly, a floor panel 62*b* is hingedly attached at one edge to the lower edge of the sidewall 14. An adhesion tab 66*b* is divided from the remainder of the floor panel 62*b* by a fold line 64*b*. Each of the opposing sidewalls 20, 32 is hingedly attached at its lower edge to a respective floor tab 68*a*, 68*b***.

Figure 4:
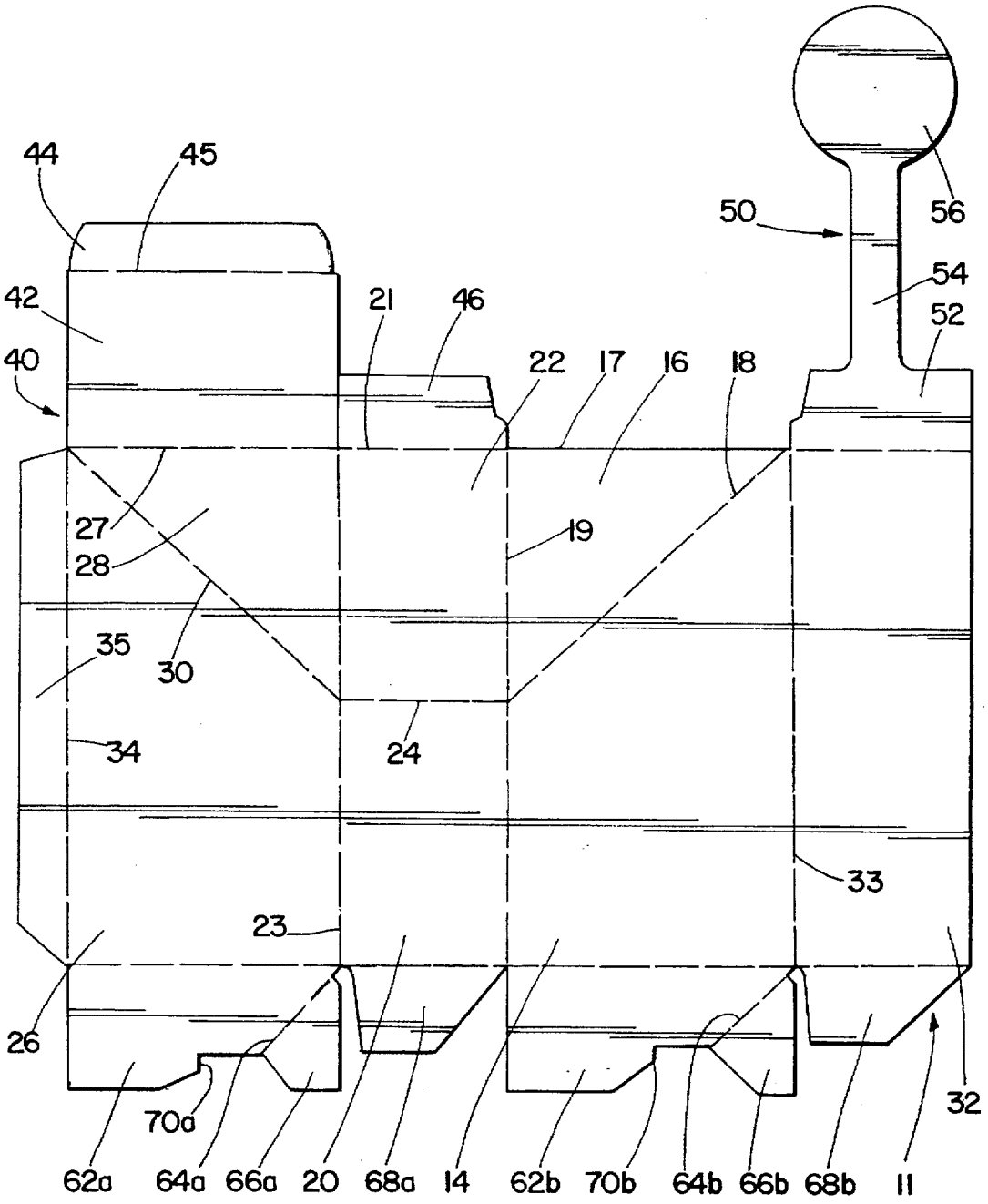
FIG. 4 is a plan view of a sheet blank that can be folded to form the shipping container of FIG. 1.

As will be recognized by those skilled in this art, the container 10 and carton 12 of the present invention are preferably integrally formed from a unitary sheet material blank, such as that designated at 11 in FIG. 4. This blank 11 can be produced by stamping the sheet material from a larger sheet (see FIG. 5) or otherwise producing a generally planar shape which can subsequently be folded into a desired three-dimensional configuration. It is also preferred that, during the forming of the blank 11, the perforations 18, 24, 30 are formed in the blank 11, as well as the fold lines which define the shared edges of the sidewalls 14, 20, 26, 32, the cover panel 42, the locking panel 44, and the flag member 50.

Illustratively and preferably, one side of the blank 11 includes printed images. In this configuration, folding of the blank 11 into the box-type configuration produces a box with printed images on all exterior surfaces without requiring that the blank 11 be printed with images on both surfaces.

It is preferred that the sheet material used for the blank 11 be formed of a chipboard-type cardboard; however, it will be recognized by those skilled in this art that virtually any foldable sheet material, such as a paper, corrugated cardboard or polymeric sheet, could also be employed and folded into a container of the present invention. It will also be recognized that, particularly with a moldable polymeric material, the shipping container 20 and carton 12 can be produced in a three-dimensional form without first forming a blank 11.

Once the blank 11 has been formed, it is then folded about its various fold lines to form the shipping container 10 of FIGS. 2 and 3. The panels of the blank 11 that form the sidewalls 14, 20, 26, and 32 are folded along their respective shared edges 19, 23, 33, 34. The free edge of the sidewall 32 present in the blank 11 is positioned to overlap the exterior surface of an extension tab 35 that extends from the edge 33 of the sidewall 26 and is secured therewith by an adhesive. Also, the floor tab **68*a* is positioned to underlie the adhesion section 66*a* and is secured thereto with an adhesive; similarly, the floor tab 68*b* is positioned to underlie the adhesion section 66*b*** and secured thereto with an adhesive.

Figure 7:
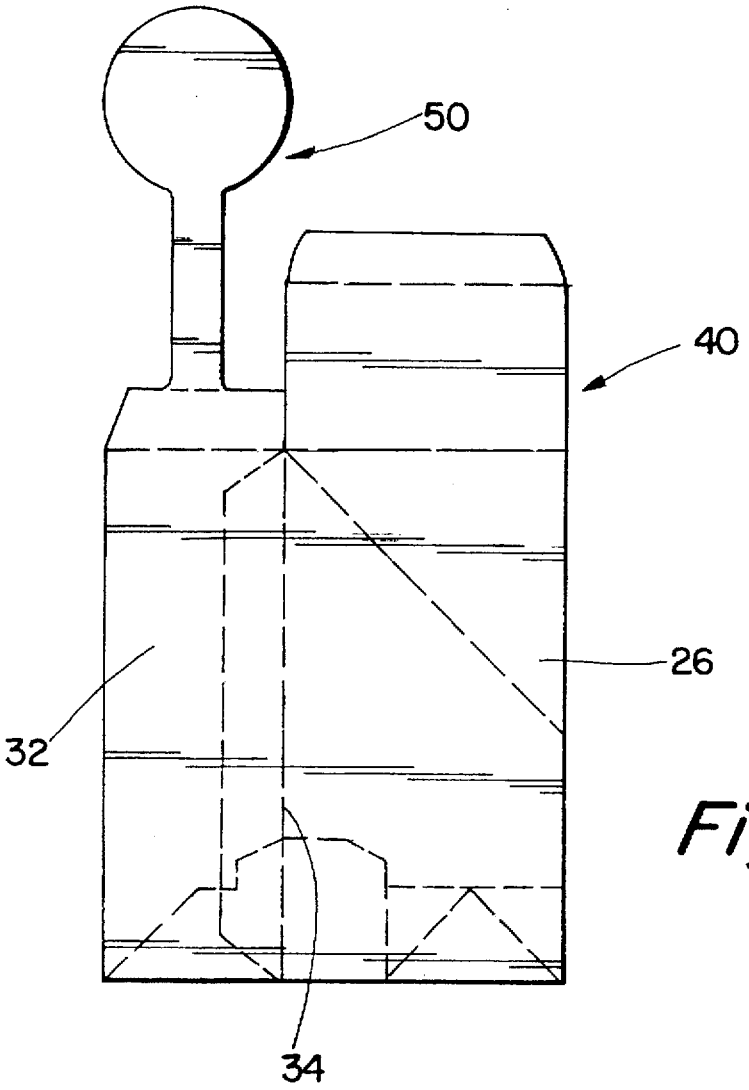
FIG. 7 is a plan view of the shipping container of FIG. 1 in a flattened condition.

Notably, once the extension tab 35 has been adhered to the sidewall 26 and the floor 60 has been formed, the shipping container 10 can be folded to a relatively flat condition (see FIG. 7) in which one pair of sidewalls 14, 20 overlies the opposed pair of sidewalls 26, 32. The floor 60 folds along the fold lines **64*a*, 64*b* such that the exterior (lower) surfaces of the floor panels 62*a*, 62*b* confront the exterior (lower) surfaces of the floor tabs 68*a*, 68*b* within the sidewalls of the shipping container 10. From this configuration, the shipping container 10 can then be formed into a three dimensional box shape by pressing the edges 19, 34 toward each other until cutouts 70***a*, 70*b* of the floor panels 62*a*, 62*b* interlock to form the floor 60.

Once the floor 60 has been formed, the product to be shipped, stored and displayed within the shipping container 10 and display container 12 is then introduced into a product cavity 36 defined by the sidewalls 14, 20, 26, 32 and the floor 60. This product can be any product that is suitable for display within a display container; the display container is particularly suitable for multiple packages of a product, such as packaged foods and the like, that can be individually removed from the display container by a consumer.

After the product is loaded into the product cavity 36, the flag member 50 is then folded to overlie the product cavity 36 (FIG. 3), with the shaft portion 54 being generally horizontally disposed. The flag portion 56 is folded relative to the shaft portion 54 so that it is generally vertically disposed and rests against the interior surface of the sidewall 20. The folding tab 46 is then folded to overlie the end of the shaft portion 54 to which the flag portion 56 is attached. Finally, the shipping container 10 is closed by folding the cover 40 relative to the sidewall 26 so that the cover panel 42 is generally horizontally disposed and overlies the product cavity 36, the flag member 50, and the folding tab 46. The locking panel 44 is folded relative to the cover panel 42 into a generally vertical position contacting the interior surface of the sidewall 14. The flag member base 52 and the folding tab 46 interact with the locking panel 44 to retain the cover 40 in its closed position.

Once the shipping container 10 is in its closed position, it can be packed in a larger crate with similarly shaped shipping containers 10. The rectangular shape of the container 10 facilitates the minimizing of shipping space within a shipping crate. Once the shipping crate is filled with a desired number of shipping containers 10, it can be sent to a retail store for display of the product.

Figure 1:
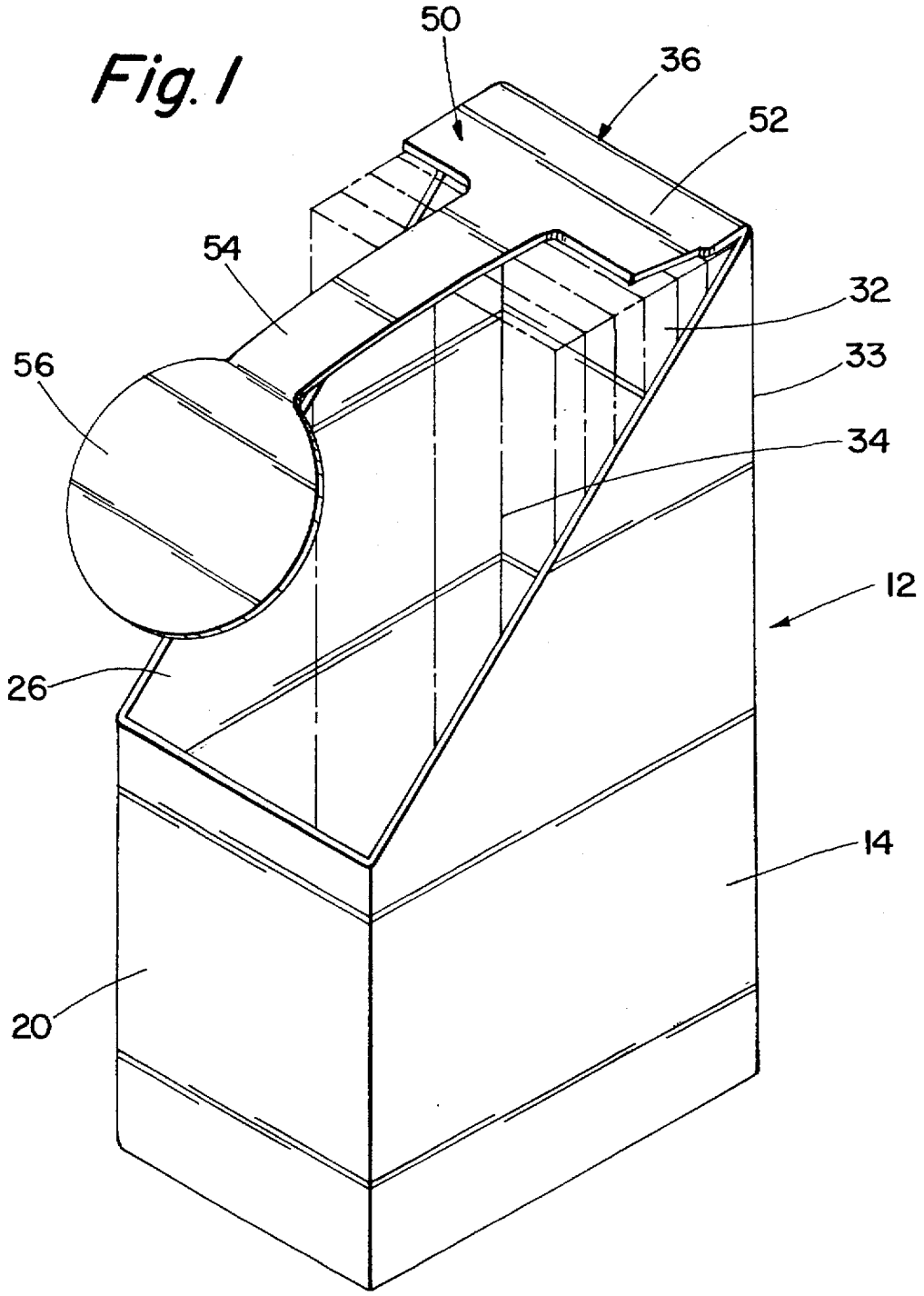
FIG. 1 is a perspective view of a display container of the present invention.

Upon the arrival of shipping containers 10 at a point of sale outlet, each shipping container 10 is taken from the shipping crate, and the removable sections 16, 22, 28 of the sidewalls 14, 20, 26 are removed from the remainder of the shipping container 10 by tearing along the perforations 18, 24, 30. Because these perforations 18, 24, 30 are continuous, the removable sections 16, 22, 28 can be easily removed as a single piece. This action forms the display container 12 (FIG. 1).

It is noteworthy that, when the removable sections 16, 22, 28 are removed, the cover 40 and the folding tab 46 are also removed. However, the flag member 50, which is attached to the sidewall 32 that is free of perforations, remains with the display container 12 and overlies the product cavity 36. The flag portion 56 dangles from the end of the shaft portion 54 above the sidewall 20 and is therefore positioned to draw a customer's eye to the product contained within the display container 12.

Notably, the display container 12 provides the eye-catching flag portion 56 without the use of multiple pieces. As a result, a point-of-sale employee can convert the shipping container 10 to a display container 12 without having to assemble multiple pieces; instead, simply by tearing along the perforations already present in the shipping container 10, the point-of-sale employee can produce the flag-bearing display container 12.

It is also significant that the constructed display container 12 has printed images on its exterior surfaces, including the flag portion 56 and shaft portion 54 of the flag member 50. This is accomplished with the blank 11 having been printed on only one surface, which reduces cost and complexity of production of the blank 11, and without any secondary operations, such as the addition of an adhesive label.

Those skilled in this art will appreciate that, although it is preferred that the display container of the present invention be formed from a shipping container having a cover, a display container which lacks a cover or lid that is subsequently removed can be employed. In addition, any cover or lid need not be one which reversibly moves between open and closed positions; instead, the cover can be glued or otherwise fixed into position after the product is stored within the shipping container. The same is true of the floor of the container, which can be fixed rather then being foldable into a flattened condition after assembly.

The precise shapes of the container and its components can also vary. For example, although the rectangular box shape defined by the sidewalls and floor of the illustrated container is preferred for its packing facility, the shipping and display container of the present invention can take many other shapes, such as square, circular, triangular, octagonal, hexagonal, pentagonal, and oval. Further, the circular flag portion 56 of the flag member 50 may take many forms; exemplary alternatives include square, diamond-shaped, octagonal (e., a "stop sign" flag), triangular, and oval flag portions. The flag member 50 may extend from the rear sidewall as illustrated, or may extend from any other desired side wall. Although the sloping nature of the container sidewalls from rear to front is preferred to facilitate access to the products contained therein, it is intended that the present invention encompass non-sloping sidewalls also, or can be discontinuous.

Further, those skilled in this art will recognize that, although sections such as removable sections 16, 22, 28 that can be completely separated and removed from the remainder of the sidewalls, other types of frangible sections, such as those which fold to overlie the remaining portions of the side wall rather than separating therefrom, can also be used with the present invention. Additionally, the perforations or score lines that define the frangible sections of the container can be continuous such that the frangible sections of the container are contiguous, or can be discontinuous.

The foregoing embodiments are illustrative of the present invention, and are not to be construed as limiting thereof. The invention is defined by the following claims, with equivalents of the claims to be included therein.

That which is claimed is:

1. A display container for displaying goods for sale, said display container being formed from a unitary sheet material and comprising:

a receptacle for receiving the product, said receptacle having a floor and a plurality of upright side walls attached thereto defining a product cavity, said product cavity having an open upper end; and a display flag comprising a cantilevered shaft member attached to an upper edge of one of said upright side walls and extending generally horizontally therefrom over a portion of said product cavity upper end, and further comprising a flag member attached to an end of said shaft member and extending generally vertically therefrom while said shaft member is extending generally horizontally over said product cavity.

2. The display container defined in claim 1, wherein said plurality of side walls includes a pair of opposed side walls, said cantilevered shaft member is attached to a first of said opposed side walls, and said flag member dangles generally in vertical alignment with and over a second of said opposed side walls.

3. The display container defined in claim 1, wherein said flag member is generally circular.

4. The display container defined in claim 2, wherein said first side wall has an upper edge that is positioned above an upper edge of said second side wall.

5. The display container defined in claim 1, wherein said floor is rectangular.

6. The display container defined in claim 1, wherein said flag member includes a printed image on one surface thereof.

7. A container suitable for shipping and displaying a product, comprising:

a receptacle for storing the product, said receptacle having a floor and a plurality of upright side walls attached thereto defining a product cavity, a first of said side walls including a frangible section, and a second of said side walls being free of a frangible section;

a cover panel attached to an upper edge of said first side wall, said cover panel being generally horizontally disposed and overlying said product cavity to restrict access thereto;

a display flag comprising a cantilevered shaft member hingedly attached to an upper edge of said second side wall and a flag portion attached to an end of said shaft member opposite said second side wall;

said first side wall being configured such that removal of said frangible section removes said cover panel and provides access to said product cavity;

said display flag being configured to underlie said cover panel prior to removal of said cover panel and said frangible section and to overlie said product cavity when said cover panel and said frangible section are removed, said display flag being generally horizontally disposed over said product cavity when said container is used for displaying product.

8. The container defined in claim 7, wherein a plurality of said adjacent side walls include frangible sections and said frangible sections are contiguous.

9. The container defined in claim 7, wherein said container is formed of a unitary sheet material.

10. The container defined in claim 7, wherein said first side wall is adjacent said second side wall.

11. The container defined in claim 7, wherein a third of said plurality of side walls is adjacent said first side wall, and further comprising a folding tab hingedly attached to an upper edge of said third side wall.

12. The container defined in claim 11, wherein said floor is rectangular, and wherein said plurality of walls is four walls, and wherein a fourth of said side walls has a free upper edge.

13. The container defined in claim 7, wherein when said display flag overlies said product cavity, said flag member is disposed generally vertically.

14. The container defined in claim 7, wherein said display flag shaft portion further comprises a base portion that interlocks with said cover panel.

15. The container defined in claim 7, in combination with a product positioned and stored within the product cavity.

16. The container defined in claim 7, wherein said frangible sections are removable sections.

17. A container for shipping a product, comprising:

a receptacle for storing the product, said receptacle having a floor and a plurality of upright side walls attached thereto defining a product cavity, a first of said side walls including a frangible section, and a second of said side walls being free of a frangible section;

a cover panel attached to an upper edge of said first side wall, said cover panel being generally horizontally disposed and overlying said product cavity to restrict access thereto;

a display flag comprising a cantilevered shaft member hingedly attached to an upper edge of said second side wall and a flag portion attached to an end of said shaft member opposite said second side wall;

said first side wall being configured such that removal of said frangible section removes cover panel and provides access to said product cavity;

said display flag being configured to underlie said cover panel prior to removal of said cover panel and said frangible section and to overlie said product cavity when said cover panel and said frangible section are removed, wherein when said cover panel is in the closed position, said flag member contacts an internal surface of an opposed side wall.

18. A sheet material blank for forming a shipping and display container, comprising a sheet material formed of a plurality of adjacent panels, said plurality of panels including:

a series of serially joined side wall panels having top, bottom and side edges, wherein each of said side wall panels shares a side edge with at least one adjacent panel;

a plurality of floor panels, each of which shares an edge with a bottom edge of a side wall;

a cover panel joined at an edge with a first side wall panel top edge; and a display flag panel having a shaft portion and a flag portion, said shaft portion being joined at an edge with a second side wall panel top edge, said flag portion having a width not greater than the width of said second side wall panel, said shaft portion having a length substantially equal to the width of said first side wall panel.

19. The sheet material blank defined in claim 18, wherein said flag panel shaft portion is substantially the same length as the width of said first side wall panel.

20. A sheet material blank for forming a shipping and display container, comprising a sheet material formed of a plurality of adjacent panels, said plurality of panels including:

a series of serially joined side wall panels having top, bottom and side edges, wherein each of said side wall panels shares a side edge with at least one adjacent panel;

a plurality of floor panels, each of which shares an edge with a bottom edge of a side wall;

a cover panel joined at an edge with a first side wall panel top edge; and a display flag panel having a shaft portion and a flag portion, said shaft portion being joined at an edge with a second side wall panel top edge;

wherein said first side wall panel includes a frangible section, and said second side wall panel is free of a frangible section.

21. The sheet material blank defined in claim 20, wherein said serially joined side wall panels include a plurality of contiguous side wall panels having contiguous frangible sections.

22. The sheet material blank defined in claim 21, wherein said contiguous frangible sections terminate at opposite ends of said second side wall panel top edge.

23. The sheet material blank defined in claim 20, further comprising a folding tab panel attached to the top edge of a third side wall panel.

24. The sheet material blank defined in claim 20, wherein one surface of said blank includes printed images thereon, and wherein an opposed surface of said blank has no printed images thereon.

* * * * *